US007097550B2

(12) United States Patent
Kawahara et al.

(10) Patent No.: US 7,097,550 B2
(45) Date of Patent: Aug. 29, 2006

(54) CHEMICAL MECHANICAL POLISHING PAD

(75) Inventors: Kouji Kawahara, Chuo-ku (JP); Kou Hasegawa, Chuo-ku (JP); Fujio Sakurai, Chuo-ku (JP)

(73) Assignee: JSR Corporation, Tokyo (JP)

( * ) Notice: Subject to any disclaimer, the term of this patent is extended or adjusted under 35 U.S.C. 154(b) by 0 days.

(21) Appl. No.: 11/133,220

(22) Filed: May 20, 2005

(65) Prior Publication Data

US 2005/0260942 A1 Nov. 24, 2005

(30) Foreign Application Priority Data

May 24, 2004 (JP) ..... 2004-153335

(51) Int. Cl.
*B24D 11/00* (2006.01)
*B24B 29/00* (2006.01)

(52) U.S. Cl. ..... 451/526; 451/527; 451/533; 451/530

(58) Field of Classification Search ..... 451/41, 451/285, 287, 288, 526, 527, 528, 529, 533, 451/530
See application file for complete search history.

(56) References Cited

U.S. PATENT DOCUMENTS

| | | | | |
|---|---|---|---|---|
| 5,650,039 | A | 7/1997 | Talieh | |
| 5,984,769 | A | 11/1999 | Bennett et al. | |
| 6,641,471 | B1 * | 11/2003 | Pinheiro et al. | 451/526 |
| 6,736,709 | B1 | 5/2004 | James et al. | |
| 6,749,714 | B1 * | 6/2004 | Ishikawa et al. | 156/345.12 |
| 2003/0119425 | A1 | 6/2003 | Suzuki | |

FOREIGN PATENT DOCUMENTS

| | | | |
|---|---|---|---|
| EP | 0 878 270 | A2 | 11/1998 |
| EP | 1164559 | * | 5/2001 |
| EP | 1 418 021 | A1 | 5/2004 |
| EP | 1 447 841 | A1 | 8/2004 |
| EP | 1 468 785 | A2 | 10/2004 |
| EP | 1 479 479 | A1 | 11/2004 |
| EP | 1 561 541 | A1 | 8/2005 |
| JP | 8-39423 | | 2/1996 |
| JP | 8-216029 | | 8/1996 |
| JP | 11-70463 | | 3/1999 |

* cited by examiner

*Primary Examiner*—Eileen P. Morgan
(74) *Attorney, Agent, or Firm*—Oblon, Spivak, McClelland, Maier & Neustadt, P.C.

(57) ABSTRACT

A chemical mechanical polishing pad which can be advantageously used for the polishing of a metal film or the polishing of an insulating film, provides a flat polished surface, enables slurry to be efficiently removed, has sufficiently long service life, can provide a high polishing rate and has the effect of reducing the number of scratches. This polishing pad has one or more grooves on its polishing surface, wherein the groove(s) is/are formed in the polishing surface in such a manner that it/they intersect(s) a single virtual straight line extending from the center portion toward the peripheral portion of the polishing surface a plurality of times and has/have a width of 0.1 to 1.5 mm and a depth of 0.9 to 9.8 mm, the shortest distance between adjacent intersections between it/them and the virtual straight line is 0.3 to 2.0 mm, and the ratio of the depth of the groove(s) to the thickness of the polishing pad is 1/7 to 1/1.1.

19 Claims, No Drawings

CHEMICAL MECHANICAL POLISHING PAD

FIELD OF THE INVENTION

The present invention relates to a chemical mechanical polishing pad.

DESCRIPTION OF THE PRIOR ART

In the manufacture of a semiconductor device, chemical mechanical polishing (CMP) is attracting much attention as a polishing technique capable of forming an extremely flat surface. Chemical mechanical polishing is a technique for polishing by letting an aqueous dispersion for chemical mechanical polishing, for example, an aqueous dispersion of abrasive grains flow down over the surface of a chemical mechanical polishing pad while the polishing pad and the surface to be polished are brought into slide contact with each other. It is known that the polishing result is greatly affected by the shape and properties of the polishing pad in this chemical mechanical polishing.

Heretofore, chemical mechanical polishing has been carried out by using polyurethane foam containing pores as a polishing pad to hold slurry in holes (to be referred to as "pores" hereinafter) which are open to the surface of the resin. It is known that the polishing rate and the polishing result are improved by forming grooves in the polishing surface of the chemical mechanical polishing pad (JP-A 11-70463, JP-A 8-216029 and JP-A 8-39423) (the term "JP-A" as used herein means an "unexamined published Japanese patent application").

However, due to the improvement of the performance and the downsizing of a semiconductor device, the wiring pattern is becoming finer, the number of wiring layers is increasing and the performance required for chemical mechanical polishing and a chemical mechanical polishing pad is becoming higher. Although the design of a chemical mechanical polishing pad is described in detail in the above JP-A 11-70463, the polishing rate and the state of the polished surface are still unsatisfactory. There is a case where a surface defect like a scratch (to be referred to as "scratch" hereinafter) occurs, and the improvement of this defect is desired.

In general, when the chemical mechanical polishing of an object is carried out continuously, a gradual reduction in polishing rate is observed and the surface state of the polished surface becomes worse. Therefore, it is necessary to carry out interval dressing each time chemical mechanical polishing is made on a certain number of objects. That is, deposits on the surface of the pad are removed by suspending the chemical mechanical polishing step and so-called "dressing" must be carried out with a dresser such as a diamond cutter to regenerate the surface of the pad. In the conventionally known chemical mechanical pad, this interval dressing is required every 1 to 5 times of polishing, which causes a production yield problem. Since frequent interval dressing is required, the service life of the chemical mechanical polishing pad is short.

SUMMARY OF THE INVENTION

It is an object of the present invention to provide a chemical mechanical polishing pad which can be advantageously used for the polishing of a metal film or the polishing of an insulating film, can provide a flat polished surface, enables slurry to be removed efficiently, has sufficiently long service life, can provide a high polishing rate and has the effect of reducing the number of scratches.

Other objects and advantages of the present invention will become apparent from the following description.

According to the present invention, the above objects and advantages of the present invention are attained by a polishing pad having one or more grooves on the polishing surface, wherein the groove(s) is/are formed in the polishing surface in such a manner that it/they intersect(s) a single virtual straight line extending from the center portion toward the peripheral portion of the polishing surface a plurality of times and has/have a width of 0.1 to 1.5 mm and a depth of 0.9 to 9.8 mm, the shortest distance between adjacent intersections between it/them and the virtual straight line is 0.3 to 4.0 mm, and the ratio of the depth of the groove(s) to the thickness of the polishing pad is 1/7 to 1/1.1.

DETAILED DESCRIPTION OF THE PREFERRED EMBODIMENT

The above groove(s) is/are open to the polishing surface of the chemical mechanical polishing pad. The groove(s) serve(s) to hold slurry supplied at the time of polishing and distribute it to the polishing surface more uniformly. It/they also serve(s) to hold wastes such as chips generated by polishing and used slurry temporarily and become a discharge route for discharging the wastes to the outside.

The shape of the groove(s) on the polishing surface is not particularly limited. One or more, for example, one or two spiral grooves which expand gradually from the center portion to the peripheral portion of the polishing surface, or a plurality of annular or polygonal grooves which do not cross one another and are arranged concentrically are examples of the groove(s). The annular grooves may be circular or elliptic, and the polygonal grooves may be tetragonal, hexagonal, etc.

These grooves are formed in the polishing surface in such a manner that they intersect a single virtual straight line extending from the center portion toward the peripheral portion of the polishing surface a plurality of times. For example, when the grooves are annular and the number of the annular grooves is 2, the number of intersections is 2, when the number of the annular grooves is 3, the number of intersections is 3, and when the number of the annular grooves is "n", the number of intersections is "n". In the case of a single spiral groove, the number of intersections is 2 after the start of the second turn (one turn is 360°) and "n" after the start of the "n"-th turn, and in the case of two spiral grooves, the number of intersections is 2 before the second turn, 3 after the start of the second turn and (n+1) after the start of the "n"-th turn.

When polygonal grooves are formed, the same can be said.

When annular or polygonal grooves are formed, they are arranged not to cross one another and may be arranged concentrically or eccentrically but preferably concentrically. The annular grooves are preferably circular grooves, more preferably circular grooves which are arranged concentrically. A polishing pad having circular grooves which are arranged concentrically is superior in the above functions to other polishing pads. When the circular grooves are arranged concentrically, the obtained polishing pad is excellent in the above functions and the formation of the grooves is easy.

The sectional form in the width direction, that is, a direction perpendicular to the groove direction of each of the grooves is not particularly limited. It may be, for example, polygonal with three or more sides consisting of flat sides and a bottom side, U-shaped or V-shaped.

The width of the grooves is in the range of 0.1 to 1.5 mm, preferably 0.1 to 1.4 mm, more preferably 0.2 to 1.2 mm. When grooves having a width smaller than 0.1 mm are formed, their holding force of slurry greatly lowers and it may be technical difficult to form such grooves.

The depth of the grooves is in the range of 0.9 to 9.8 mm, preferably 1.0 to 7.0 mm, more preferably 1.4 to 4.5 mm. When the depth of the grooves is smaller than 0.9 mm, the service life of the polishing pad becomes too short disadvantageously.

As for the interval between grooves, the shortest distance between adjacent intersections between the grooves and the above virtual straight line extending from the center portion toward the peripheral portion of the polishing surface is 0.3 to 4.0 mm, and the shortest distance between adjacent grooves is 0.3 to 4.0 mm, preferably 0.5 to 3.0 mm, more preferably 0.5 to 2.0 mm.

Further, the ratio of the depth of the grooves to the thickness of the polishing pad is in the range of 1/7 to 1/1.1, preferably 1/6 to 1/1.2, more preferably 1/4 to 1/1.3. When the ratio of the depth of the grooves to the thickness of the polishing pad is lower than 1/7, the polishing pad becomes too thick and cannot be used actually. When the ratio is higher than 1/1.1, the depth of the grooves and the thickness of the polishing pad become almost the same, a portion between adjacent grooves may fall, and the grooves may not be maintained.

The polishing surface may have a recessed portion other than the grooves. An example of the recessed portion is a dot pattern which is a recessed portion having an opening of circular, polygonal opening, and the like.

The polishing pad having the above grooves may be made of any material if it can serve as a polishing pad. It is preferred that pores having the function of holding slurry during polishing and the function of holding polishing chips temporarily out of the functions of the polishing pad should be formed by the time of polishing. Therefore, the polishing pad is preferably made of a material consisting of water-soluble particles and a water-insoluble matrix containing the water-soluble particles dispersed therein, or a material consisting of cavities and a water-insoluble matrix material containing the cavities dispersed therein, for example, foam.

In the former material out of these, the water-soluble particles dissolve or swell upon their contact with an aqueous medium of slurry containing an aqueous medium and solid matter at the time of polishing to be eliminated, and slurry can be held in pores formed by elimination. In the latter material, the slurry can be held in pores formed as the cavities.

The material for forming the above "water-insoluble matrix" is not particularly limited but an organic material is preferably used because it is easily molded to have a predetermined shape and predetermined properties and can provide suitable hardness and suitable elasticity. Examples of the organic material include thermoplastic resins, elastomers, rubbers such as crosslinked rubbers, and curable resins such as thermally or optically curable resins and resins cured by heat or light. They may be used alone or in combination.

Out of these, the above thermoplastic resins include 1,2-polybutadiene resin, polyolefin resins such as polyethylene, polystyrene resins, polyacrylic resins such as (meth) acrylate-based resins, vinyl ester resins (excluding acrylic resins), polyester resins, polyamide resins, fluororesins such as polyvinylidene fluoride, polycarbonate resins and polyacetal resins.

The above elastomers include diene elastomers such as 1,2-polybutadiene, polyolefin elastomer (TPO), styrene-based elastomers such as styrene-butadiene-styrene block copolymer (SBS) and hydrogenated block copolymers thereof (SEBS), thermoplastic elastomers such as thermoplastic polyurethane elastomers (TPU), thermoplastic polyester elastomers (TPEE) and polyamide elastomers (TPAE), silicone resin elastomers and fluororesin elastomers. The above rubbers include conjugated diene rubbers such as butadiene rubber (high cis-butadiene rubber, low cis-butadiene rubber, etc.), isoprene rubber, styrene-butadiene rubber and styrene-isoprene rubber, nitrile rubbers such as acrylonitrile-butadiene rubber, acrylic rubber, ethylene-α-olefin rubbers such as ethylene-propylene rubber and ethylene-propylene-diene rubber, butyl rubber, silicone rubber and fluorine rubber.

The above curable resins include urethane resins, epoxy resins, acrylic resins, unsaturated polyester resins, polyurethane-urea resins, urea resins, silicon resins, phenolic resins and vinyl ester resins.

These organic materials may be modified by an acid anhydride group, carboxyl group, hydroxyl group, epoxy group or amino group. The affinity for the water-soluble particles to be described hereinafter and slurry of the organic material can be adjusted by modification.

These organic materials may be used alone or in combination of two or more.

The organic material may be a partially or wholly crosslinked polymer or non-crosslinked polymer. Therefore, the water-insoluble matrix may be composed of a crosslinked polymer alone, a mixture of a crosslinked polymer and a non-crosslinked polymer, or a non-crosslinked polymer alone. It is preferably composed of a crosslinked polymer alone or a mixture of a crosslinked polymer and a non-crosslinked polymer. When a crosslinked polymer is contained, elastic recovery force is provided to the water-insoluble matrix and displacement caused by shear stress applied to the polishing pad during polishing can be reduced. Further, it is possible to effectively prevent the pores from being filled by the plastic deformation of the water-insoluble matrix when it is excessively stretched at the time of polishing and dressing and the surface of the polishing pad from being excessively fluffed. Therefore, the pores are formed efficiently even during dressing, whereby the deterioration of the holding properties of the slurry during polishing can be suppressed and further the polishing pad is rarely fluffed, thereby not impairing polishing flatness. The method of crosslinking the above material is not particularly limited. For example, chemical crosslinking making use of an organic peroxide, sulfur or sulfur compound, or radiation crosslinking by applying an electron beam may be employed.

Out of the above organic materials, a crosslinked rubber, curable resin, crosslinked thermoplastic resin or crosslinked elastomer may be used as the crosslinked polymer. A crosslinked thermoplastic resin and/or crosslinked elastomer all of which are stable to a strong acid or strong alkali contained in many kinds of slurry and are rarely softened by water absorption are/is preferred. Out of the crosslinked thermoplastic resin and crosslinked elastomer, what is crosslinked with an organic peroxide is more preferred, and crosslinked 1,2-polybutadiene is particularly preferred.

The amount of the crosslinked polymer is not particularly limited but preferably 30 vol % or more, more preferably 50 vol % or more, particularly preferably 70 vol % or more and may be 100 vol % of the water-insoluble matrix. When the amount of the crosslinked polymer contained in the water-insoluble matrix is smaller than 30 vol %, the effect obtained by containing the crosslinked polymer may not be fully obtained.

The residual elongation after breakage (to be simply referred to as "residual elongation at break" hereinafter) of the above water-insoluble matrix containing a crosslinked polymer can be 100% or less when a specimen of the above water-insoluble matrix is broken at 80° C. in accordance with JIS K 6251. That is, the total distance between bench marks of the specimen after breakage becomes 2 times or less the distance between the bench marks before breakage. This residual elongation at break is preferably 30% or less, more preferably 10% or less and particularly preferably 5% or less. When the above residual elongation at break is more than 100%, fine pieces scraped off from the surface of the polishing pad or stretched at the time of polishing and surface renewal tend to fill the pores disadvantageously. The "residual elongation at break" is an elongation obtained by subtracting the distance between bench marks before the test from the total distance between each bench mark and the broken portion of the broken and divided specimen in a tensile test in which a dumbbell-shaped specimen No. 3 is broken at a tensile rate of 500 mm/min and a test temperature of 80° C. in accordance with the "vulcanized rubber tensile test method" specified in JIS K 6251. The test is carried out at 80° C. because heat is generated by slide contact at the time of actual polishing.

The above "water-soluble particles" are particles which are eliminated from the water-insoluble matrix upon their contact with slurry as an aqueous dispersion in the polishing pad. This elimination may occur when they dissolve in water contained in the slurry upon their contact with water or when they swell and gel by absorbing this water. Further, this dissolution or swelling is caused not only by their contact with water but also by their contact with an aqueous mixed medium containing an alcohol-based solvent such as methanol.

The water-soluble particles have the effect of increasing the indentation hardness of the polishing pad in addition to the effect of forming pores in the polishing pad. For example, the shore D hardness of the polishing pad of the present invention can be set to preferably 35 to 100, more preferably 40 to 90, particularly preferably 45 to 85 by adding the water-soluble particles. When the shore D hardness is 35 or more, pressure applied to the object to be polished can be increased, and the polishing rate can be thereby improved. In addition, high polishing flatness is obtained. Therefore, the water-soluble particles are particularly preferably made of a solid substance which can ensure sufficiently high indentation hardness for the polishing pad.

The material for forming the water-soluble particles is not particularly limited. They are, for example, organic water-soluble particles or inorganic water-soluble particles. Examples of the material of the organic water-soluble particles include saccharides (polysaccharides such as starch, dextrin and cyclodextrin, lactose, mannitol, etc.), celluloses (such as hydroxypropyl cellulose, methyl cellulose, etc.), protein, polyvinyl alcohol, polyvinyl pyrrolidone, polyacrylic acid, polyethylene oxide, water-soluble photosensitive resins, sulfonated polyisoprene and sulfonated polyisoprene copolymers. Examples of the material of the inorganic water-soluble particles include potassium acetate, potassium nitrate, potassium carbonate, potassium hydrogencarbonate, potassium chloride, potassium bromide, potassium phosphate and magnesium nitrate. These water-soluble particles may be used alone or in combination of two or more. The water-soluble particles may be made of a predetermined single material, or two or more different materials.

The water-soluble particles have an average particle diameter of preferably 0.1 to 500 μm, more preferably 0.5 to 100 μm. The pores are as big as preferably 0.1 to 500 μm, more preferably 0.5 to 100 μm. When the average particle diameter of the water-soluble particles is smaller than 0.1 μm, the formed pores become smaller in size than the abrasive grains in use, whereby a polishing pad capable of holding slurry completely may be hardly obtained. When the average particle diameter is larger than 500 μm, the formed pores become too big, whereby the mechanical strength and polishing rate of the obtained polishing pad may lower.

The amount of the water-soluble particles is preferably 1 to 90 vol %, more preferably 1 to 60 vol %, particularly preferably 1 to 40 vol % based on 100 vol % of the total of the water-insoluble matrix and the water-soluble particles. When the amount of the water-soluble particles is smaller than 1 vol %, pores are not fully formed in the obtained polishing pad and the polishing rate may lower. When the amount of the water-soluble particles is larger than 90 vol %, it may be difficult to completely prevent the water-soluble particles existent in the interior of the obtained polishing pad from swelling or dissolving, thereby making it difficult to maintain the hardness and mechanical strength of the polishing pad at appropriate values.

It is preferred that the water-soluble particles should dissolve in water only when they are exposed to the surface layer of the polishing pad and should not absorb moisture or swell when they are existent in the interior of the polishing pad. Therefore, the water-soluble particles may have an outer shell for suppressing moisture absorption on at least part of their outermost portion. This outer shell may be physically adsorbed to the water-soluble particle, chemically bonded to the water-soluble particle, or in contact with the water-soluble particle by physical adsorption and chemical bonding. The outer shell is made of epoxy resin, polyimide, polyamide or polysilicate. Even when it is formed on only part of the water-soluble particle, the above effect can be fully obtained.

The above water-insoluble matrix may contain a compatibilizing agent to control its affinity for the water-soluble particles and the dispersibility of the water-soluble particles in the water-insoluble matrix. Examples of the compatibilizing agent include homopolymers, block copolymers and random copolymers modified by an acid anhydride group, carboxyl group, hydroxyl group, epoxy group, oxazoline group or amino group, nonionic surfactants and coupling agents.

The water-insoluble matrix material constituting the polishing pad comprising the latter water-insoluble matrix material (foam, etc.) containing cavities dispersed therein is, for example, a polyurethane, melamine resin, polyester, polysulfone or polyvinyl acetate.

The average size of the cavities dispersed in the above water-insoluble matrix material is preferably 0.1 to 500 μm, more preferably 0.5 to 100 μm.

The water-insoluble matrix may further comprise at least one selected from abrasive grains, oxidizing agent, alkali metal hydroxide, acid, pH modifier, surfactant and scratch inhibitor which have been conventionally contained in slurry, in addition to the above compatibilizing agent. Thereby, polishing can be carried out by supplying only water during polishing.

Examples of the above abrasive grains include silica, alumina, ceria, zirconia and titania particles. They may be used alone or in combination of two or more.

Examples of the above oxidizing agent include organic peroxides such as hydrogen peroxide, peracetic acid, perbenzoic acid and tert-butyl hydroperoxide, permanganic acid compounds such as potassium permanganate, bichromic acid compounds such as potassium bichromate, halogen acid compounds such as potassium iodate, nitric acid compounds such as nitric acid and iron nitrate, perhalogen acid compounds such as perchloric acid, persulfates such as ammonium persulfate, and heteropoly acid. Out of these oxidizing agents, hydrogen peroxide and organic peroxides whose decomposed products are harmless and persulfates such as ammonium persulfate are particularly preferred. They may be used alone or in combination of two or more.

Examples of the above alkali metal hydroxide include sodium hydroxide, potassium hydroxide, rubidium hydroxide and cesium hydroxide. They may be used alone or in combination of two or more.

The above acid may be either organic or inorganic. Examples of the organic acid include paratoluenesulfonic acid, dodecylbenzenesulfonic acid, isoprenesulfonic acid, gluconic acid, lactic acid, citric acid, tartaric acid, maloniic acid, glycolic acid, malonic acid, formic acid, oxalic acid, succinic acid, fumaric acid, maleic acid and phthalic acid. Examples of the inorganic acid include nitric acid, hydrochloric acid and sulfuric acid. These acids may be used alone or in combination of two or more.

The above surfactant is, for example, a cationic surfactant or anionic surfactant. Examples of the anionic surfactant include aliphatic acid soap, carboxylates such as alkyl ether carboxylates, sulfonates such as alkylbenzenesulfonates, alkylnaphthalenesulfonates and α-olefin sulfonates, sulfuric acid esters such as higher alcohol sulfuric acid ester salts, alkyl ether sulfates and polyoxyethylene alkylphenyl ether sulfates, and phosphoric acid ester salts such as alkyl phosphoric acid ester salts. They may be used alone or in combination of two or more.

Examples of the above scratch inhibitor include biphenol, bipyridyl, 2-vinylpyridine, 4-vinylpyridine, salicylaldoxime, o-phenylenediamine, m-phenylenediamine, catechol, o-aminophenol, thiourea, N-alkyl group-containing (meth)acrylamide, N-aminoalkyl group-containing (meth) acrylamide, 7-hydroxy-5-methyl-1,3,4-triazaindolizine, 5-methyl-1H-benzotriazole, phthalazine, melamine and 3-amino-5,6-dimethyl-1,2,4-triazine. They may be used alone or in combination of two or more.

The water-insoluble matrix may further contain additives such as filler, softener, antioxidant, ultraviolet light absorber, antistaic agent, lubricant and plasticizer besides the above compatibilizing agent and other materials which have been conventionally contained in slurry. Examples of the filler include materials for improving stiffness, such as calcium carbonate, magnesium carbonate, talc and clay, and materials having a polishing effect, such as silica, alumina, ceria, zirconia, titanium oxide, zirconium oxide, manganese dioxide, dimanganese trioxide and barium carbonate.

The polishing pad of the present invention has a polishing surface, a non-polishing surface opposite to the polishing surface and a side surface for defining the polishing surface and the non-polishing surface. The shape of the polishing pad is not particularly limited. It may be shaped like a disk or polygonal pole. Preferably, the shape of the polishing pad is suitably selected according to a polishing machine. The size of the polishing pad before use is not particularly limited. For example, a disk-like polishing pad has a diameter of 0.5 to 500 cm, preferably 1.0 to 250 cm, more preferably 20 to 200 cm and a thickness of more than 0.1 mm and 100 mm or less, particularly preferably 1 to 10 mm.

The process for manufacturing the polishing pad of the present invention is not particularly limited, and the method of forming the groove(s) of the polishing pad is not particularly limited as well. For example, after a composition for forming a polishing pad which will become a polishing pad is prepared and molded into a substantially desired form, the groove(s) may be formed by cutting. Alternatively, a metal mold having a groove pattern is used to mold the composition for forming a polishing pad, thereby making it possible to form the grove(s) simultaneously with the manufacture of the polishing pad. The surface roughness of the inner wall of the groove(s) can be easily set to 20 μm or less by molding.

The method of obtaining the composition for forming a polishing pad is not particularly limited. For example, the composition can be obtained by kneading together required materials including a predetermined organic material by means of a kneader. A conventionally known kneader may be used, such as a roll, kneader, Banbury mixer or extruder (single-screw, multiple-screw).

The composition for forming a polishing pad, which comprises water-soluble particles for obtaining a polishing pad containing water-soluble particles, can be obtained, for example, by kneading together a water-insoluble matrix, water-soluble particles and other additives. In general, they are kneaded together under heating so that they can be easily processed at the time of kneading. The water-soluble particles are preferably solid at this kneading temperature. When they are solid, they can be dispersed with the above preferred average particle diameter irrespective of their compatibility with the water-insoluble matrix.

Therefore, the type of the water-soluble particles is preferably selected according to the processing temperature of the water-insoluble matrix in use.

The chemical mechanical polishing pad of the present invention may be a multi-layer pad having a base layer formed on the non-polishing surface of the above pad.

The above "base layer" is a layer formed on the rear surface to support the chemical mechanical polishing pad. Although the characteristic properties of this base layer are not particularly limited, the base layer is preferably softer than the pad body. When the pad has a soft base layer, if the pad body is thin, for example, 1.0 mm or less, it is possible to prevent the pad body from rising during polishing or the surface of the polishing layer from curving, whereby polishing can be carried out stably. The hardness of the base layer is preferably 90% or less, more preferably 50 to 90%, much more preferably 50 to 80%, particularly preferably 50 to 70% of the shore D hardness of the pad body.

The base layer may be made of a porous material (foam) or a non-porous material. The planar shape of the base layer is not particularly limited and may be the same or different from that of the polishing layer. The planar shape of the base layer may be circular or polygonal, for example, tetragonal. Its thickness is not particularly limited but preferably 0.1 to 5 mm, more preferably 0.5 to 2 mm.

Although the material of the base layer is not particularly limited, an organic material is preferably used because it can be easily molded to have a predetermined shape and predetermined properties and can provide suitable elasticity.

The above-described chemical mechanical polishing pad of the present invention can provide a flat polished surface and a high polishing rate and has sufficiently long service life.

The chemical mechanical polishing pad of the present invention can be used for chemical mechanical polishing by known methods when it is set in a commercially available polishing machine.

The type of the surface to be polished and the type of the aqueous dispersion for chemical mechanical polishing in use are not particularly limited.

EXAMPLES

The following examples are given to further illustrate the present invention.

[1] Manufacture of Polishing Pad

Example 1

70 parts by volume of 1,2-polybutadiene (manufactured by JSR Corporation, trade name of JSR RB830) which would be crosslinked to become a water-insoluble matrix and 30 parts by volume of β-cyclodextrin (manufactured by Bio Research Corporation of Yokohama, trade name of Dexy Pearl β-100, average particle diameter of 20 μm) as water-soluble particles were kneaded together by an extruder set at 160° C. to obtain a white pellet. Thereafter, 0.3 part by volume of an organic peroxide (manufactured by NOF Corporation, trade name of Percumyl D-40) was added to and kneaded with the above pellet at 120° C., and the resulting kneaded product was extruded into a metal mold and heated at 170° C. for 18 minutes to be crosslinked so as to obtain a disk-like molded product having a diameter of 60 cm and a thickness of 3.0 mm. Thereafter, concentrically circular grooves having a width of 0.25 mm, a depth of 1.5 mm, a pitch of 2.00 mm and a shortest distance between adjacent grooves of 1.75 mm were formed on one side of this molded product by using a cutting machine (Kato Machinery Co., Ltd.) (ratio of the depth of the grooves to the thickness of the polishing layer=1/2.0).

Example 2

Concentrically circular grooves having a width of 0.25 mm, a depth of 2.31 mm, a pitch of 2.00 mm and a shortest distance between adjacent grooves of 1.75 mm were formed on one side of a 3.0 mm-thick disk-like molding object which was molded in the same manner as in Example 1 by using a cutting machine (of Kato Machinery Co., Ltd.) (ratio of the depth of the grooves to the thickness of the polishing layer=1/1.3).

Example 3

Concentrically circular grooves having a width of 0.25 mm, a depth of 1.5 mm, a pitch of 2.25 mm and a shortest distance between adjacent grooves of 2.00 mm were formed on one side of a 6.0 mm-thick disk-like molding object which was molded in the same manner as in Example 1 by using a cutting machine (of Kato Machinery Co., Ltd.) (ratio of the depth of the grooves to the thickness of the polishing layer=1/4.0).

Example 4

Concentrically circular grooves having a width of 1.00 mm, a depth of 3.0 mm, a pitch of 2.00 mm and a shortest distance between adjacent grooves of 1.00 mm were formed on one side of a 6.0 mm-thick disk-like molding object which was molded in the same manner as in Example 1 by using a cutting machine (of Kato Machinery Co., Ltd.) (ratio of the depth of the grooves to the thickness of the polishing layer=1/2.0).

Example 5

Concentrically circular grooves having a width of 0.25 mm, a depth of 4.5 mm, a pitch of 2.25 mm and a shortest distance between adjacent grooves of 2.00 mm were formed on one side of a 6.0 mm-thick disk-like molding object which was molded in the same manner as in Example 1 by using a cutting machine (of Kato Machinery Co., Ltd.) (ratio of the depth of the grooves to the thickness of the polishing layer=1/1.3).

Example 6

Concentrically circular grooves having a width of 0.25 mm, a depth of 1.5 mm, a pitch of 2.00 mm and a shortest distance between adjacent grooves of 1.75 mm were formed on one side of a 9.0 mm-thick disk-like molding object which was molded in the same manner as in Example 1 by using a cutting machine (of Kato Machinery Co., Ltd.) (ratio of the depth of the grooves to the thickness of the polishing layer=1/6.0).

Example 7

Concentrically circular grooves having a width of 0.25 mm, a depth of 2.25 mm, a pitch of 2.00 mm and a shortest distance between adjacent grooves of 1.00 mm were formed on one side of a 9.0 mm-thick disk-like molding object which was molded in the same manner as in Example 1 by using a cutting machine (of Kato Machinery Co., Ltd.) (ratio of the depth of the grooves to the thickness of the polishing layer=1/4.0).

Example 8

Concentrically circular grooves having a width of 0.25 mm, a depth of 8.18 mm, a pitch of 2.00 mm and a shortest distance between adjacent grooves of 1.75 mm were formed on one side of a 9.0 mm-thick disk-like molding object which was molded in the same manner as in Example 1 by using a cutting machine (of Kato Machinery Co., Ltd.) (ratio of the depth of the grooves to the thickness of the polishing layer=1/1.1).

Example 9

28.2 parts by mass of polytetramethylene glycol having two hydroxyl groups at both terminals of the molecule and a number average molecular weight of 650 (manufactured by Mitsubishi Chemical Co., Ltd., trade name of PTMG650) and 21.7 parts by mass of 4,4'-diphenylmethane diisocyanate (manufactured by Sumika Bayer Urethane Co., Ltd., trade name of Sumidule 44S) were fed to a reactor and maintained at 90° C. for 3 hours under agitation to carry out a reaction and then cooled to obtain a prepolymer having an isocyanate group at both terminals.

14.5 parts by mass of β-cyclodextrin (manufactured by Bio Research Corporation of Yokohama, trade name of Dexy Pearl β-100, average particle diameter of 20 μm) as water-soluble particles was dispersed into 21.6 parts by mass of polypropylene glycol having three hydroxyl groups and a number average molecular weight of 330 (manufactured by NOF Corporation, trade name of Uniol TG300, addition reaction product of glycerin and propylene oxide) and 6.9 parts by mass of the PTMG650 polytetramethylene glycol as crosslinking agents by agitation, and further 0.1 part by mass of 2-methyl triethylenediamine (manufactured by Sankyo Air Products Co., Ltd., trade name of Me-DABCO) was dissolved in the obtained dispersion as a reaction accelerator by agitation. The resulting mixture was added to the reactor of the above prepolymer having an isocyanate group at both terminals.

Further, 21.6 parts by mass of the Sumidule 44S 4,4'-diphenylmethane diisocyanate was added to the above reactor of the prepolymer having an isocyanate group at both terminals, stirred at 200 rpm at room temperature for 2 minutes and defoamed under reduced pressure to obtain a raw material mixture.

This raw material mixture was injected into a metal mold having a diameter of 60 cm and a thickness of 3 mm and maintained at 80° C. for 20 minutes to synthesize a polyurethanation and further post-cured at 110° C. for 5 hours to obtain a polishing pad having a diameter of 60 cm and a thickness of 3 mm. Thereafter, concentrically circular grooves having a width of 0.25 mm, a depth of 1.5 mm, a pitch of 2.00 mm and a shortest distance between adjacent grooves of 1.75 mm were formed on one side of this molded product by using a cutting machine (of Kato Machinery Co., Ltd.) (ratio of the depth of the grooves to the thickness of the polishing layer=1/2.0).

Example 10

At a temperature of 65° C., 2,997 g of the Adiprene L-325 (of Uniroyal Co., Ltd.) which is a polyether-based urethane prepolymer was mixed with 768 g of 4,4'-methylene-bis[2-chloroaniline], and then 69 g of the Expansel 511DE (of Expansel Co., Ltd.) was dispersed in the obtained mixture to produce a raw material mixture.

This raw material mixture was injected into a metal mold having a diameter of 60 cm and a thickness of 3.0 mm and maintained at 80° C. for 20 minutes to carry out a polyurethanation reaction and further post-cured at 110° C. for 5 hours to obtain a disk-like molded product having a diameter of 60 cm and a thickness of 3.0 mm. Thereafter, concentrically circular grooves having a width of 0.25 mm, a depth of 1.5 mm, a pitch of 2.00 mm and a shortest distance between adjacent grooves of 1.75 mm were formed on one side of this molded product by using a cutting machine (of Kato Machinery Co., Ltd.) (ratio of the depth of the grooves to the thickness of the polishing layer=1/2.0).

The average diameter of cavities dispersed in the matrix of the above manufactured polishing pad was 10 μm.

Example 11

99 parts by volume of 1,2-polybutadiene (manufactured by JSR Corporation, trade name of JSR RB830) which would be crosslinked to become a water-insoluble matrix and 1 part by volume of β-cyclodextrin (manufactured by Bio Research Corporation of Yokohama, trade name of Dexy Pearl β-100, average particle diameter of 20 μm) as water-soluble particles were kneaded together by an extruder set at 160° C. to obtain a white pellet. Thereafter, blending, kneading and molding were carried out in the same manner as in Example 1 to produce a disk-like molded product having a diameter of 60 cm and a thickness of 3.0 mm. Concentrically circular grooves having a width of 0.25 mm, a depth of 1.5 mm, a pitch of 2.00 mm and a shortest distance between adjacent groove of 1.75 mm were formed on one side of this molded product by using a cutting machine (of Kato Machinery Co., Ltd.) (ratio of the depth of the grooves to the thickness of the polishing layer=1/2.0).

Example 12

90 parts by volume of 1,2-polybutadiene (manufactured by JSR Corporation, trade name of JSR RB830) which would be crosslinked to become a water-insoluble matrix and 10 parts by volume of β-cyclodextrin (manufactured by Bio Research Corporation of Yokohama, trade name of Dexy Pearl β-100, average particle diameter of 20 μm) as water-soluble particles were kneaded together by an extruder set at 160° C. to obtain a white pellet. Thereafter, blending, kneading and molding were carried out in the same manner as in Example 1 to produce a disk-like molded product having a diameter of 60 cm and a thickness of 3.0 mm. Concentrically circular grooves having a width of 0.35 mm, a depth of 1.5 mm, a pitch of 4.00 mm and a shortest distance between adjacent grooves of 3.5 mm were formed on one side of this molded product by using a cutting machine (Kato Machinery Co., Ltd.) (ratio of the depth of the grooves to the thickness of the polishing layer=1/2.0).

Comparative Example 1

Concentrically circular grooves having a width of 0.25 mm, a depth of 2.90 mm, a pitch of 2.00 mm and a shortest distance between adjacent groove of 1.75 mm were formed on one side of a 3.0 nun-thick disk-like molding object which was molded in the same manner as in Example 1 by using a cutting machine (of Kato Machinery Co., Ltd.) (ratio of the depth of the grooves to the thickness of the polishing layer=1/1.05).

Comparative Example 2

Concentrically circular grooves having a width of 0.25 mm, a depth of 0.75 mm, a pitch of 2.00 mm and a shortest distance between adjacent groove of 1.75 mm were formed on one side of a 3.0 mm-thick disk-like molding object which was molded in the same manner as in Example 1 by using a cutting machine (of Kato Machinery Co., Ltd.) (ratio of the depth of the grooves to the thickness of the polishing layer=1/4.0).

Comparative Example 3

Concentrically circular grooves having a width of 0.25 mm, a depth of 0.38 mm, a pitch of 2.00 mm and a shortest distance between adjacent groove of 1.75 mm were formed on one side of a 3.0 mm-thick disk-like molding object which was molded in the same manner as in Example 1 by using a cutting machine (of Kato Machinery Co., Ltd.) (ratio of the depth of the grooves to the thickness of the polishing layer=1/8.0).

Comparative Example 4

Concentrically circular grooves having a width of 0.50 mm, a depth of 0.85 mm, a pitch of 3.00 mm and a shortest distance between adjacent groove of 2.50 mm were formed on one side of a 2.0 mm-thick disk-like molding object which was molded in the same manner as in Example 10 by using a cutting machine (of Kato Machinery Co., Ltd.) (ratio of the depth of the grooves to the thickness of the polishing layer=1/2.35).

[2] Evaluation of Polishing Efficiency (1) Evaluation of Interval Dressing

The polishing pads obtained in Examples 1 to 12 and Comparative Example 1 to 4 were each set on the platen of a polishing machine (EPO112 of Ebara Corporation), and 8-inch wafers having a copper film were polished at a platen revolution of 100 rpm, a head revolution of 105 rpm, a slurry flow rate of 200 ml/min and a polishing load of 105 hPa for 60 seconds to count the number of polished wafers before the polishing rate was changed by 5% or more. The iCue5003 (of Cabot Microelectronics Co., Ltd.) was used as slurry. The polishing rate was measured with the Omnimap RS75 of KLA-Tencor Co., Ltd.

(2) Evaluation of Service Life of Chemical Mechanical Polishing Pad

The chemical mechanical polishing of 8-inch wafers having a copper film was carried out continuously under the above polishing conditions. Interval dressing was carried out with a 100-mesh diamond dresser at a platen revolution of 20 rpm, a dresser revolution of 19 rpm and a dresser load of 60 N for 30 seconds while ion exchange water was supplied at a rate of 100 ml/min.

The polishing rate was calculated every 50 polished wafers to obtain the point of time when the polishing rate 15% or more lower than the previous average value of polishing rate was recorded two times in a row as the service life of the chemical mechanical polishing pad.

(3) Evaluation of Scratches

The chemical mechanical polishing of 8-inch wafers having a copper film was carried out continuously under the above polishing conditions. The evaluation of scratches was made on the polished wafers with the SP1 of KLA-Tencor Co., Ltd. The evaluation was made on the entire polished surfaces of the wafers.

The results of the above evaluations (1) to (3) are shown in Table 1 below.

TABLE 1

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Groove width (mm) | 0.25 | 0.25 | 0.25 | 1.00 | 0.25 | 0.25 | 0.25 | 025 |
| Groove depth (mm) | 1.5 | 2.31 | 1.5 | 3.0 | 4.5 | 2.25 | 1.5 | 8.18 |
| Interval between grooves (mm) | 1.75 | 1.75 | 2.00 | 1.00 | 2.00 | 1.75 | 1.75 | 1.75 |
| Thickness of polishing layer(mm) | 3.0 | 3.0 | 6.0 | 6.0 | 6.0 | 9.0 | 9.0 | 9.0 |
| Ratio of groove depth to polishing layer thickness | 1/2.0 | 1/1.3 | 1/4.0 | 1/2.0 | 1/1.3 | 1/4.0 | 1/6.0 | 1/1.1 |
| Interval dressing (number of wafers per dressing) | 10 | 13 | 10 | 17 | 20 | 14 | 10 | 25 |
| Pad life (number of wafers) | 1000 | 1500 | 1550 | 1700 | >2000 | 1500 | 1000 | >2000 |
| Number of scratches | 113 | 78 | 105 | 100 | 50 | 83 | 120 | 47 |

| | Ex. 9 | Ex. 10 | Ex. 11 | Ex. 12 | C.Ex. 1 | C.Ex. 2 | C.Ex. 3 | C.Ex. 4 |
|---|---|---|---|---|---|---|---|---|
| Groove width (mm) | 0.25 | 0.25 | 0.25 | 0.25 | 0.25 | 0.25 | 0.25 | 0.50 |
| Groove depth (mm) | 1.50 | 1.50 | 1.50 | 1.50 | 2.9 | 0.75 | 0.38 | 0.85 |
| Interval between grooves (mm) | 1.75 | 1.75 | 1.75 | 3.5 | 1.75 | 1.75 | 1.75 | 2.50 |
| Thickness of polishing layer(mm) | 3.0 | 3.0 | 3.0 | 3.0 | 3.0 | 3.0 | 3.0 | 2.0 |
| Ratio of groove depth to polishing layer thickness | 1/2.0 | 1/2.0 | 1/2.0 | 1/2.0 | 1/1.05 | 1/4.0 | 1/8.0 | 1/2.35 |
| Interval dressing (number of wafers per dressing) | 12 | 10 | 30 | 22 | * | 5 | 3 | 4 |

TABLE 1-continued

| | | | | | | | | |
|---|---|---|---|---|---|---|---|---|
| Pad life (number of wafers) | 1200 | 1300 | 1000 | 1000 | — | 350 | 300 | 500 |
| Number of scratches | 200 | 200 | 130 | 143 | — | 1500 | 1800 | 1400 |

*portions between adjacent grooves fell during polishing
Ex.: Example
C.Ex.: Comparative Example According to the present invention, there is provided a chemical mechanical polishing pad which can provide a flat polished surface, enables slurry to be efficiently removed, has sufficiently long service life, can provide a high polishing rate and has the effect of reducing the number of scratches. The chemical mechanical polishing method for polishing a surface to be polished at a high polishing rate to provide an excellent surface state can be carried out with this chemical mechanical polishing pad.

What is claimed is:

1. A polishing pad, comprising:

at least one groove in a polishing surface of the pad, wherein said at least one groove is formed in the polishing surface in such a manner that said at least one groove intersects a single straight line which is virtual and extends from a center portion toward a peripheral portion of the polishing surface, a plurality of times and has a width of 0.1 to 1.5 mm and a depth of 0.9 to 9.8 mm, wherein the shortest distance between adjacent intersections between said at least one groove with the straight line is 0.3 to 4.0 mm, wherein the ratio of the depth of said at least one groove to the thickness of the polishing pad is 1/7 to 1/1.1, and wherein a surface roughness of an inner wall of said at least one groove is 20 μm or less.

2. The polishing pad according to claim 1, wherein said at least one groove spirals in the polishing surface expanding gradually from the center portion toward the peripheral portion of the polishing surface.

3. The polishing pad according to claim 1, which comprises a water-insoluble matrix containing a crosslinked polymer and water-soluble particles dispersed in the water-insoluble matrix.

4. The polishing pad according to claim 1, wherein the width of said at least one groove is in the range of 0.2 to 1.2 mm.

5. The polishing pad according to claim 1, wherein the depth of said at least one groove is in the range of 1.4 to 4.5 mm.

6. The polishing pad according to claim 1, wherein the shortest distance between adjacent intersections with the straight line is in the range of 0.5 to 3.0 mm.

7. The polishing pad according to claim 1, wherein the ratio of the depth of said at least one groove to the thickness of the polishing pad is in the range of 1/4 to 1/1.3.

8. The polishing pad according to claim 1, wherein the polishing surface may have a recessed portion other than the at least one groove.

9. The polishing pad according to claim 3, wherein the water-insoluble matrix is a member selected from the group consisting of thermoplastic resins, elastomers, rubbers, and curable resins and mixtures thereof.

10. The polishing pad according to claim 3, wherein the water-insoluble matrix comprises a crosslinked polymer.

11. The polishing pad according to claim 1, wherein a shore D hardness of the polishing pad is 35 to 100.

12. The polishing pad according to claim 3, wherein the water-soluble particles comprise a member selected from the group consisting of saccharides, celluloses, protein, polyvinyl alcohol, polyvinyl pyrrolidone, polyacrylic acid, polyethylene oxide, water-soluble photosensitive resins, sulfonated polyisoprene, sulfonated polyisoprene copolymers and mixtures thereof.

13. The polishing pad according to claim 3, wherein the water-soluble particles comprise a member selected from the group consisting of potassium acetate, potassium nitrate, potassium carbonate, potassium hydrogencarbonate, potassium chloride, potassium bromide, potassium phosphate, magnesium nitrate and mixtures thereof.

14. The polishing pad according to claim 3, wherein the water-soluble particles have an average particle diameter of preferably 0.1 to 500 μm.

15. The polishing pad according to claim 3, wherein an amount of the water-soluble particles is 1 to 90 vol % based on 100 vol% of the total of the water-insoluble matrix and the water-soluble particles.

16. The polishing pad according to claim 1, wherein said at least one groove is annular.

17. The polishing pad according to claim 1, wherein said at least one groove is polygonal.

18. The polishing pad according to claim 1, comprising a plurality of annular grooves which do not cross one another and are arranged concentrically on the polishing surface.

19. The polishing pad according to claim 1, comprising a plurality of polygonal grooves which do not cross one another and are arranged concentrically on the polishing surface.

* * * * *